US009278819B2

(12) United States Patent
Doshida

(10) Patent No.: US 9,278,819 B2
(45) Date of Patent: Mar. 8, 2016

(54) PAPER FEEDER AND IMAGE FORMING APPARATUS

(71) Applicant: KONICA MINOLTA, INC., Chiyoda-ku, Tokyo (JP)

(72) Inventor: Yuki Doshida, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/494,295

(22) Filed: Sep. 23, 2014

(65) Prior Publication Data

US 2015/0102552 A1 Apr. 16, 2015

(30) Foreign Application Priority Data

Oct. 15, 2013 (JP) ..... 2013-214536

(51) Int. Cl.

| | |
|---|---|
| ***B65H 1/04*** | (2006.01) |
| ***G03G 15/00*** | (2006.01) |
| ***B65H 9/10*** | (2006.01) |
| ***B65H 1/26*** | (2006.01) |

(52) U.S. Cl.

CPC ..... *B65H 1/04* (2013.01); *B65H 1/266* (2013.01); *B65H 9/101* (2013.01); *G03G 15/6529* (2013.01); *B65H 2402/542* (2013.01); *B65H 2403/41* (2013.01); *B65H 2403/531* (2013.01); *B65H 2405/114* (2013.01); *B65H 2405/121* (2013.01); *B65H 2511/12* (2013.01); *B65H 2511/22* (2013.01)

(58) Field of Classification Search

CPC ..... B65H 1/04; B65H 1/266; B65H 2220/04; B65H 2511/12

USPC ..... 271/171

See application file for complete search history.

(56) References Cited

U.S. PATENT DOCUMENTS

| | | | | |
|---|---|---|---|---|
| 7,607,657 | B2 * | 10/2009 | Kawarago | 271/171 |
| 8,052,141 | B2 * | 11/2011 | Yamagishi | B65H 1/26 271/171 |
| 8,066,277 | B2 * | 11/2011 | Ubayashi | 271/171 |
| 9,102,488 | B2 * | 8/2015 | Chiba | B65H 1/04 |
| 2009/0295072 | A1 * | 12/2009 | Blair et al. | 271/171 |

FOREIGN PATENT DOCUMENTS

| | | | |
|---|---|---|---|
| JP | 2000007162 | A | 1/2000 |
| JP | 2008105856 | A | 5/2008 |

OTHER PUBLICATIONS

Japanese Office Action (and English translation thereof) dated Jul. 29, 2015, issued in counterpart Japanese Application No. 2013-214536.

* cited by examiner

*Primary Examiner* — Jeremy R Severson

(74) *Attorney, Agent, or Firm* — Holtz, Holtz & Voltek PC

(57) ABSTRACT

A paper feeder includes a recording-media container, a width regulating member, and a locking mechanism. The recording-media container is attachable to and detachable from a body of an image forming apparatus. The recording-media container stores a recording medium. The width regulating member regulates a position in a widthwise direction of the recording medium stored in the recording-media container. The locking mechanism steplessly changes a movable range of the width regulating member in the widthwise direction. The width regulating member includes a lever configured to cooperate with the width regulating member to hold the locking mechanism so as to bring the locking mechanism into an unlocked state. The locking mechanism in a locked state restricts movement of the width regulating member in the widthwise direction, and regulates wobbling of the width regulating member in a direction orthogonal to the widthwise direction.

15 Claims, 9 Drawing Sheets

PAPER FEEDER AND IMAGE FORMING APPARATUS

CROSS-REFERENCE TO RELATED APPLICATIONS

The present application claims priority under 35 U.S.C. §119 to Japanese Patent Application No. 2013-214536, filed Oct. 15, 2013. The contents of this application are incorporated herein by reference in their entirety.

BACKGROUND OF THE INVENTION

1. Field of the Invention

The present invention relates to a paper feeder and an image forming apparatus.

2. Discussion of the Background

As conventionally known, image forming apparatuses include a paper feeder. The paper feeder loads recording media for image formation and stores the recording media. The paper feeder is capable of being put into and taken out from the body of the image forming apparatus in order to replenish and store recording media. The paper feeder includes a recording-media container and a width regulating member. The recording-media container houses recording media. The width regulating member regulates the width position of the recording media stored in the recording-media container (the width position is a position in a direction orthogonal to the conveyance direction of the recording media).

In feeding a recording medium, the width regulating member keeps the recording medium at a proper posture in the recording-media container while conforming to a predetermined conveyance standard position. For example, when the conveyance standard position is center standard position, the width regulating member often used is a pair of side regulating plates aligned in the widthwise direction of the recording media. The pair of side regulating plates are coupled to each other through a rack pinion mechanism and cooperate to move toward and away from each other in the widthwise direction of the recording media. In the rack pinion mechanism, the pinion gear is disposed on the inner bottom surface of the recording-media container. The rack is disposed at each of side regulating plates and meshes with the pinion gear at both sides of the pinion gear.

Japanese Unexamined Patent Application Publication No. 2000-7162 discloses a paper feeder that includes this type of side regulating plates. Specifically, a locking mechanism includes a locking pin and a pair of pinching racks. The locking pin is operable to move up and down on one of side regulating plates. The pair of pinching racks are fixed in the recording-media container and have a longitudinal dimension in the widthwise direction of the recording-media container. In order to fix the positions of the width regulating members with respect to recording media of an undefined size, the positions of the width regulating members are steplessly variable in the widthwise direction. Specifically, the pair of pinching racks are arranged to make their rack teeth face each other. Then, the locking pin is moved downward to force its engaging teeth at its lower end into the gap between the facing rack teeth. Thus, the engaging teeth are meshed with the facing rack teeth.

In the locking mechanism disclosed in Japanese Unexamined Patent Application Publication No. 2000-7162, the engaging teeth at the lower end of the locking pin are forced into the gap between the facing rack teeth. This ensures a firm mesh of the engagement tooth with both rack teeth. However, the firm mesh (position maintaining function) necessitates a high level of operation force for the up-and-down operation of the locking pin (locking operation and unlocking operation), leaving room for improvement in operability. In addition, the side regulating plates cooperate to move toward and away from each other in the widthwise direction, whereas the locking pin is operated upward and downward orthogonal to the widthwise direction. Thus, in the series of actions, it has been impossible to implement a one-touch action to move the locking pin upward and downward while moving the side regulating plates in the widthwise direction. Instead, it has been necessary to perform the up-and-down operation and the moving operation in the widthwise direction individually, leaving room for improvement in operability.

The present invention has been made in view of the above-described circumstances, and it is an object of the present invention to provide a locking mechanism of a width regulating member having both the good operability and the good position fixing function.

SUMMARY OF THE INVENTION

According to one aspect of the present disclosure, a paper feeder includes a recording-media container, a width regulating member, and a locking mechanism. The recording-media container is attachable to and detachable from a body of an image forming apparatus. The recording-media container is configured to store a recording medium. The width regulating member is configured to regulate a position in a widthwise direction of the recording medium stored in the recording-media container. The locking mechanism is configured to steplessly change a movable range of the width regulating member in the widthwise direction. The width regulating member includes a lever configured to cooperate with the width regulating member to hold the locking mechanism so as to bring the locking mechanism into an unlocked state. The locking mechanism in a locked state is configured to restrict movement of the width regulating member in the widthwise direction, and configured to restrict wobbling of the width regulating member in a direction orthogonal to the widthwise direction.

According to another aspect of the present disclosure, an image forming apparatus includes the above-described paper feeder.

BRIEF DESCRIPTION OF THE DRAWINGS

A more complete appreciation of the present disclosure, and many of the attendant advantages thereof will be readily obtained as the same becomes better understood by reference to the following detailed description when considered in connection with the accompanying drawings, wherein.

DESCRIPTION OF THE EMBODIMENTS

Figure 1:
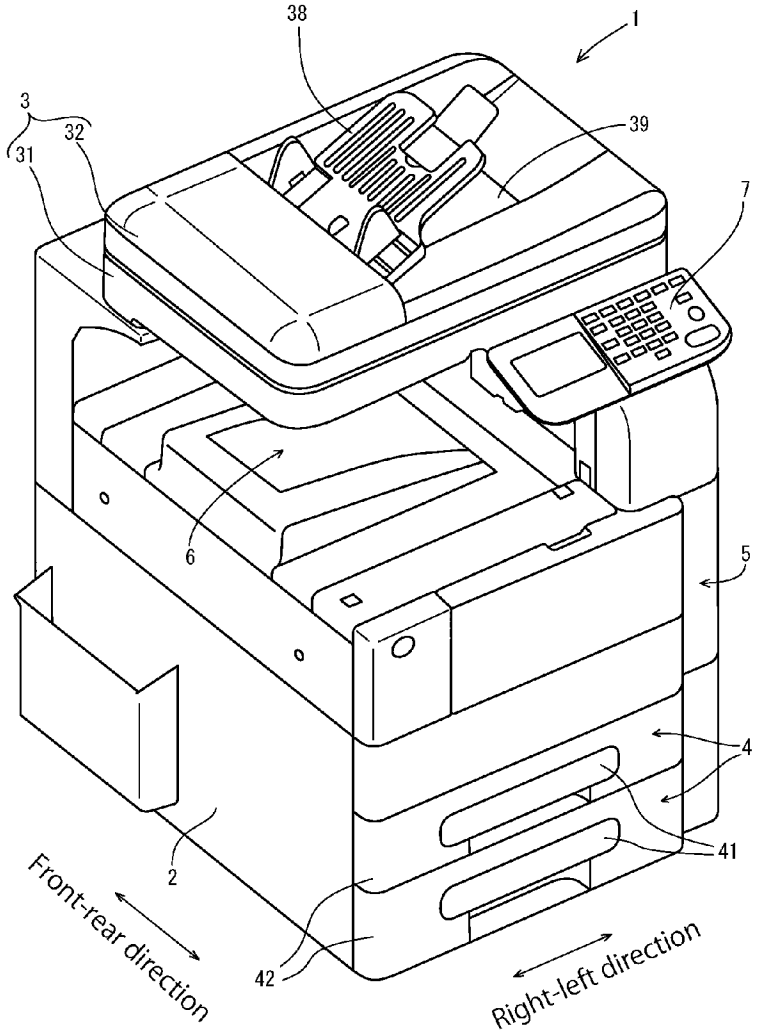
FIG. 1 is a perspective view of an exterior of an image forming apparatus.

The embodiments will now be described with reference to the accompanying drawings, wherein like reference numerals designate corresponding or identical elements throughout the various drawings.

Figure 3:
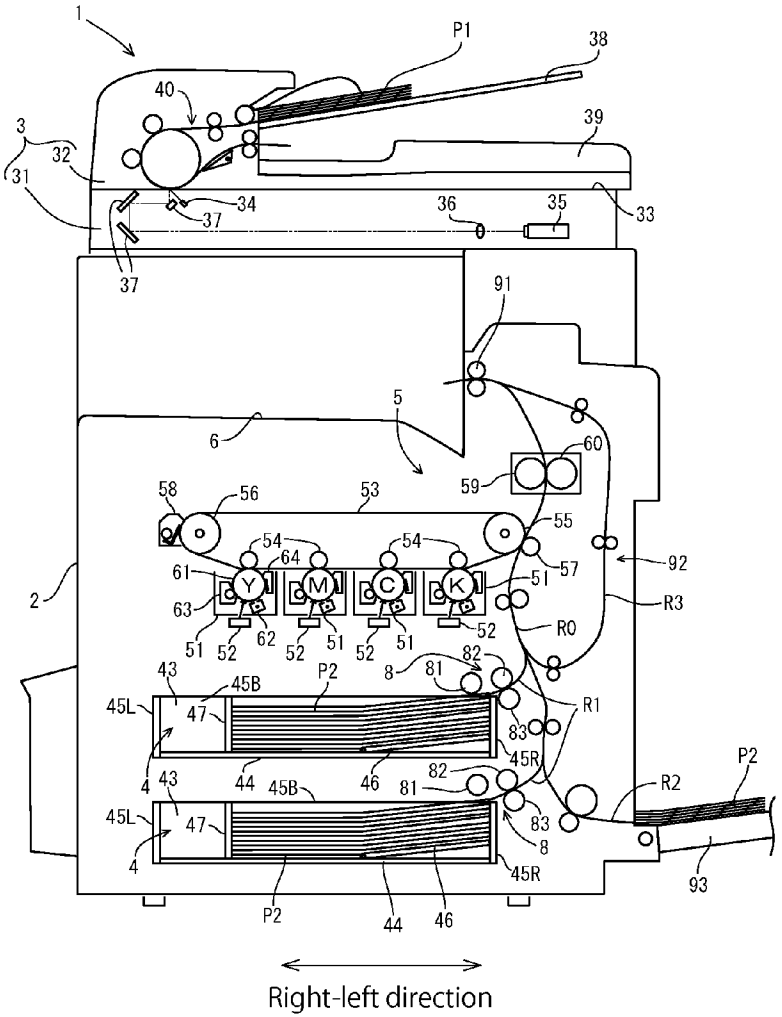
FIG. 3 schematically illustrates an inner configuration of the image forming apparatus.

In the following description, terms (for example, "left and right" and "upper and lower") indicating specific directions and positions are used where necessary. In this respect, the direction perpendicular to the paper plane of FIG. 3 is defined as front view. The terms are used for the sake of description and not intended to limit the technical scope of the present invention.

<General Arrangement of Image Forming Apparatus>

Figure 2:
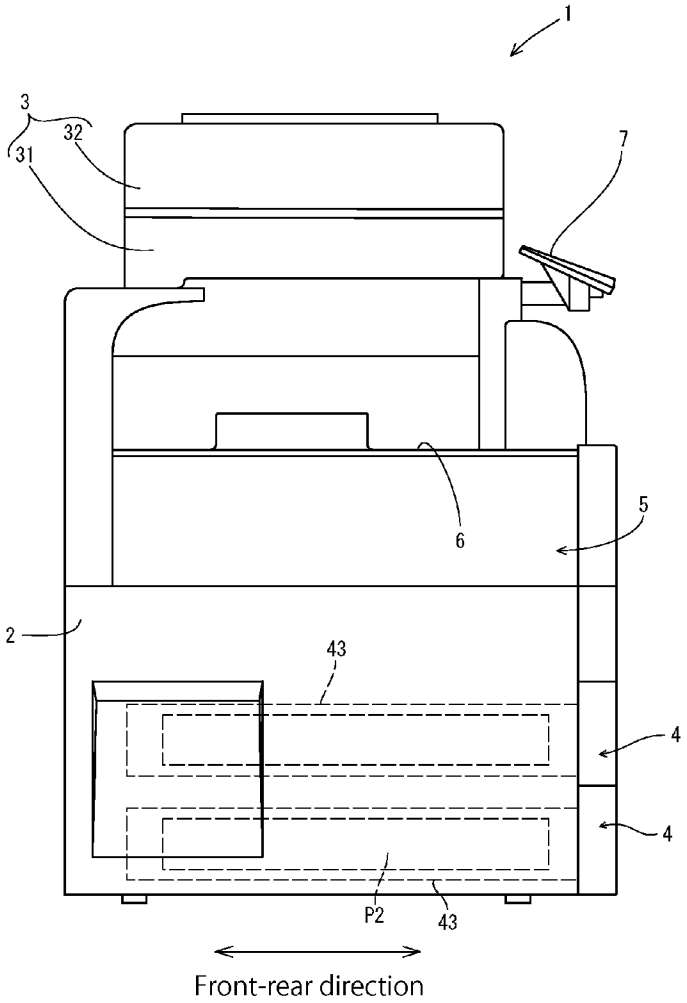
FIG. 2 is a right side view of the image forming apparatus.

A general arrangement of the image forming apparatus common to the following individual embodiments will be described below with reference to the drawings. As shown in FIGS. 1 and 2, an image forming apparatus 1 includes an image reader 3, a paper feeder 4, an image forming device 5, a paper discharge tray 6, and an operation panel 7. The image reader 3 reads an image from an original P1. The paper feeder 4 stores a recording medium P2 on which an image is to be formed. The image forming device 5 forms an image on the recording medium P2 fed from the paper feeder 4. The paper discharge tray 6 receives the recording medium P2 on which the image has been formed by the image forming device 5. The operation panel 7 receives operations for the image forming apparatus 1. The image forming apparatus 1 has a body 2, and the image reader 3 is disposed over the body 2. The image forming device 5 is disposed below the image reader 3.

The paper discharge tray 6 is disposed over the image forming device 5 in the body 2 in order to receive the recording medium P2 discharged after being loaded with the image at the image forming device 5. The paper feeder 4 is attachable and detachable and disposed below the image forming device 5 in the body 2. With this configuration, as described later, the recording medium P2 stored in the paper feeder 4 is conveyed into the body 2. Then, while the recording medium P2 is conveyed upward, an image is formed at the image forming device 5, which is disposed above the paper feeder 4. Then, the recording medium P2 is discharged onto the paper discharge tray 6, which is disposed in the space (recessed space) defined by the image reader 3 and the image forming device 5.

The image reader 3, which is disposed above the body 2, includes a scanner 31 and an auto document feeder (ADF) 32. The scanner 31 reads images from the original document P1. The auto document feeder 32 is disposed above the scanner 31 and conveys one original P1 at a time to the scanner 31. The operation panel 7 is disposed on the front side (front surface) of the body 2. On the operation panel 7, a user performs key operations while looking at the display screen or other elements on the operation panel 7 so as to perform various settings for a function selected from the functions of the image processing apparatus 1, and to instruct the image forming apparatus 1 to execute an operation.

The paper feeder 4 includes a front cover 42 and a recording-media container 43. The front cover 42 has a handle member 41 for a user to grip in attaching and detaching the paper feeder 4 to and from the body 2. The recording-media container 43 stores a stack of recording media P2. The paper feeder 4 is slidable back and forth to be attached to and detached from the body 2. When the paper feeder 4 is pushed into the body 2, the recording-media container 43 is accommodated in the body 2, and the front cover 42 serves as the front surface of the body 2. At the right side of the recording-media container 43 of the paper feeder 4, a paper feed mechanism 8, described later, is disposed (see FIG. 3). The paper feed mechanism 8 takes out a recording medium P2 stored in the recording-media container 43 and conveys the recording medium P2 to the image forming device 5.

Referring to FIG. 3, an internal structure of the body 2 will be described. The scanner 31 of the image reader 3, which is disposed above the body 2, includes an original table 33, a light source device 34, an image sensor 35, an imaging lens 36, and a mirror group 37. The original table 33 includes a platen glass (not shown) on the upper surface of the original table 33. The light source device 34 irradiates light to the original P1. The image sensor 35 photoelectrically converts reflected light from the original P1 into image data. The imaging lens 36 images the reflected light onto the image sensor 35. The mirror group 37 sequentially reflects the reflected light from the original P1 so as to make the reflected light incident on the imaging lens 36. The light source device 34, the image sensor 35, the imaging lens 36, and the mirror group 37 are disposed inside the original table 33. The light source device 34 and the mirror group 37 are laterally movable with respect to the original table 33.

The ADF 32 is disposed on the upper surface side of the scanner 31 and is openable/closable with respect to the original table 33. The ADF 32 also has a function of overlying the original P1 on the platen glass (not shown) of the original table 33 so as to keep the original P1 in close contact with the platen glass (not shown). The ADF 32 includes an original mounting tray 38 and an original discharge tray 39.

When the image reader 3 thus configured reads the original P1 on the platen glass (not shown) of the original table 33, light is irradiated to the original P1 from the light source device 34 moving in the right direction (sub-scanning direction). The reflected light reflected from the original P1 is sequentially reflected from the mirror group 37 moving in the right direction similarly to the light source device 34. Thus, the reflected light is incident on the imaging lens 36 and imaged on the image sensor 35. The image sensor 35 performs photoelectric conversion on a pixel basis according to the intensity of the incident light so as to generate an image signal (RGB signal) corresponding to the image of the original P1.

When the image reader 3 reads the original P1 mounted on the original mounting tray 38, the original P1 is conveyed to a reading position by an original conveyance mechanism 40. The original conveyance mechanism 40 is made up of a plurality of rollers and other elements. Here, the light source device 34 and the mirror group 37 of the scanner 31 are fixed at predetermined positions in the original mounting table 33. Thus, light is irradiated from the light source device 34 to a reading position of the original P1, and light reflected from the original P1 is formed into an image on the image sensor 35 via the mirror group 37 and the imaging lens 36 of the scanner 31. Then, the image sensor 35 converts the image into an image signal (RGB signal) corresponding to the image of the original P1. Then, the original P1 is discharged onto the original discharge tray 39.

The image forming device 5 serves as a transfer section to transfer a toner image onto a recording medium P2. The transfer section includes image forming sections 51, exposure sections 52, an intermediate transfer belt 53, primary transfer rollers 54, a driving roller 55, a driven roller 56, a secondary transfer roller 57, and a cleaner 58. The image forming sections 51 respectively generate toner images of colors Y (Yellow), M (Magenta), C (Cyan), and K (Key tone). The exposure sections 52 are respectively disposed below the image forming sections 51. The intermediate transfer belt 53 is brought into contact with the image forming sections 51 for the respective colors arranged in a horizontal direction so that the respective color toner images are transferred from the image forming sections 51 to the intermediate transfer belt 53. The primary transfer rollers 54 are respectively disposed at positions above and opposed to the corresponding image forming sections 51 for the respective colors as if to hold the intermediate transfer belt 53 between the image forming sections 51 and the intermediate transfer belt 53. The driving roller 55 drives the intermediate transfer belt 53. The driven roller 56 rotates upon transmission of the rotation of the driving roller 55 through the intermediate transfer belt 53. The secondary transfer roller 57 is disposed at a position opposed to the driving roller 55 with the intermediate transfer belt 53 held between the driving roller and the secondary transfer roller 57. The cleaner 58 is disposed at a position opposed to the driven roller 56 with the intermediate transfer belt 53 held between the driven roller 56 and the cleaner 58.

Each of the image forming sections 51 includes a photoreceptor drum 61, a charger 62, a developer 63, and a cleaner 64. The photoreceptor drum 61 is in contact with an outer surface of the intermediate transfer belt 53. The charger 62 charges the outer surface of the photoreceptor drum 61 by corona discharge. The developer 63 adhere toner charged by stirring to the outer surface of the photoreceptor drum 61. The cleaner 64 removes the toner remaining on the outer surface of the photoreceptor drum 61 after the toner image is transferred to the intermediate transfer belt 53. Here, the photoreceptor drum 61 is disposed at a position opposed to the primary transfer roller 54 with the intermediate transfer belt 53 held between the primary transfer roller 54 and the photoreceptor drum 61, and rotates clockwise in FIG. 3. The primary transfer roller 54, the cleaner 64, the charger 62, the exposure section 52, and the developer 63 are disposed in this order around the photoreceptor drum 61 along the rotation direction of the photoreceptor drum 61.

An example of the intermediate transfer belt 53 is a conductive endless belt member looped across the driving roller 55 and the driven roller 56 without looseness. This enables the intermediate transfer belt 53 to rotate counterclockwise in FIG. 3 in conjunction with the rotation of the driving roller 55. The secondary transfer roller 57, the cleaner section 58, and the image forming sections 51 for the respective colors YMCK are disposed in this order around the intermediate transfer belt 53 along the rotation direction of the intermediate transfer belt 53.

The image forming device 5 also serves as a fixing section to fix the toner image transferred to the recording medium P2. The fixing section includes a heating roller 59 and a pressure roller 60. The heating roller 59 is provided with a halogen lamp and other components associated with heating of the toner image on the recording medium P2 in order to fix the toner image. The pressure roller 60 cooperates with the heating roller 59 to hold the recording medium P2 between the pressure roller 60 and the heating roller 59 so as to apply pressure to the recording medium P2. The heating roller 59 may use electromagnetic induction to generate eddy current on the surface of the heating roller 59 so as to heat the surface of the heating roller 51.

The recording-media container 43 of the paper feeder 4 is in the form of a box shape with a bottom plate 44 surrounded by side plates 45F, 45B, 45L and 45R respectively on the front, rear, left, and right of the bottom plate 44. The recording medium P2 is placed on the bottom plate 44 with the right side of the recording medium P2 in contact with the inner wall of the right side plate 45R. A push-up plate 46 is disposed at the right side plate 45R on the upper surface of the bottom plate 44. The push-up plate 46 swings upward and downward the end side of the push-up plate 46 opposed to the right side plate 45R so as to push the recording medium P2 upward. Between the bottom plate 44 and the push-up plate 46, a tensile spring (not shown) is disposed to bias the push-up plate 46 upward. The tensile spring on the lower surface of the push-up plate 46 provides elastic biasing force against the weight of the recording media P2 on the push-up plate 46. This ensures that the uppermost recording medium P2 among the recording media P2 on the push-up plate 46 is arranged with the right side of the uppermost recording medium P2 at an optimum position for the paper feed mechanism 8 to pull out the uppermost recording medium P2.

Figure 4:
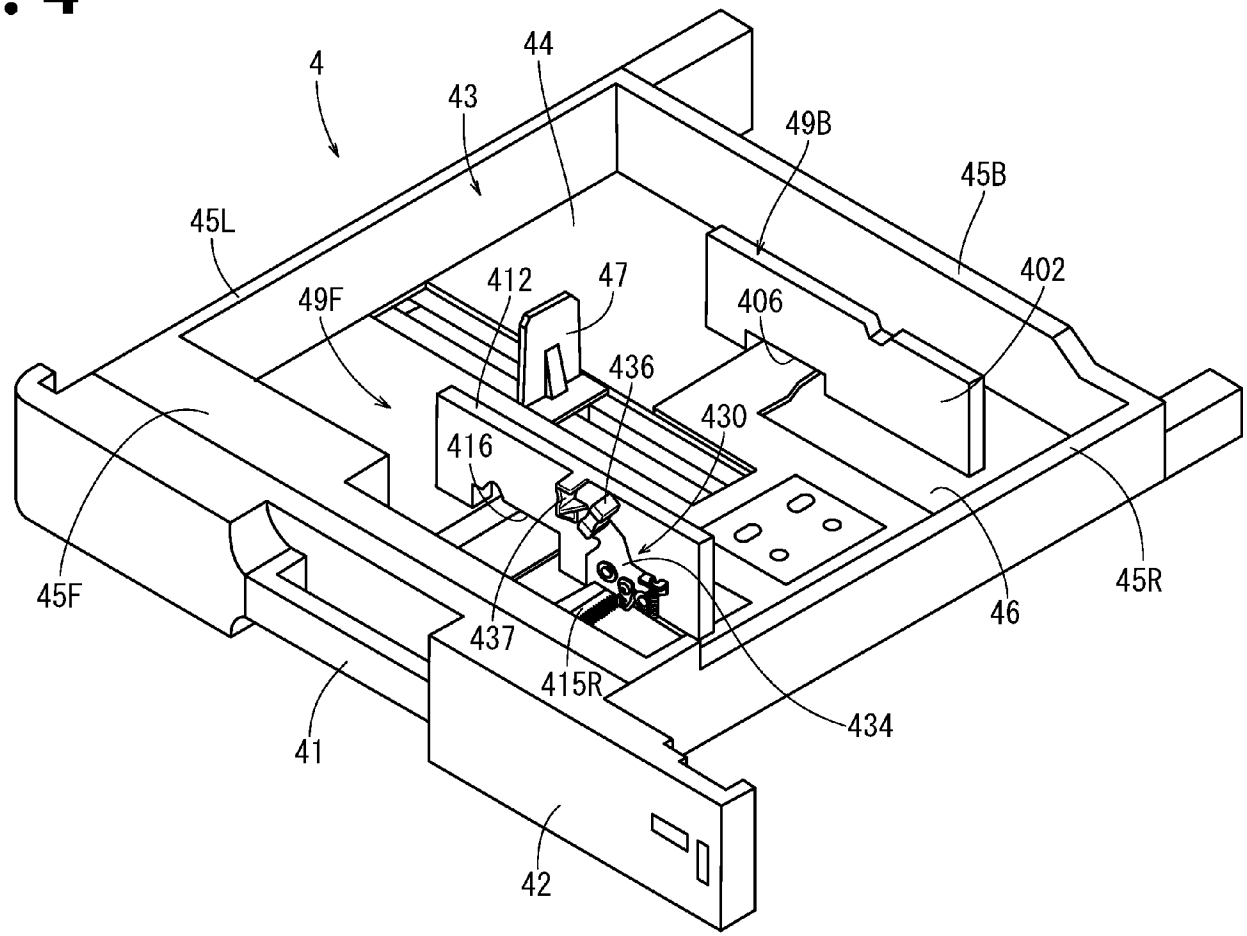
FIG. 4 is a perspective view of a paper feeder according to a first embodiment.
Figure 5:
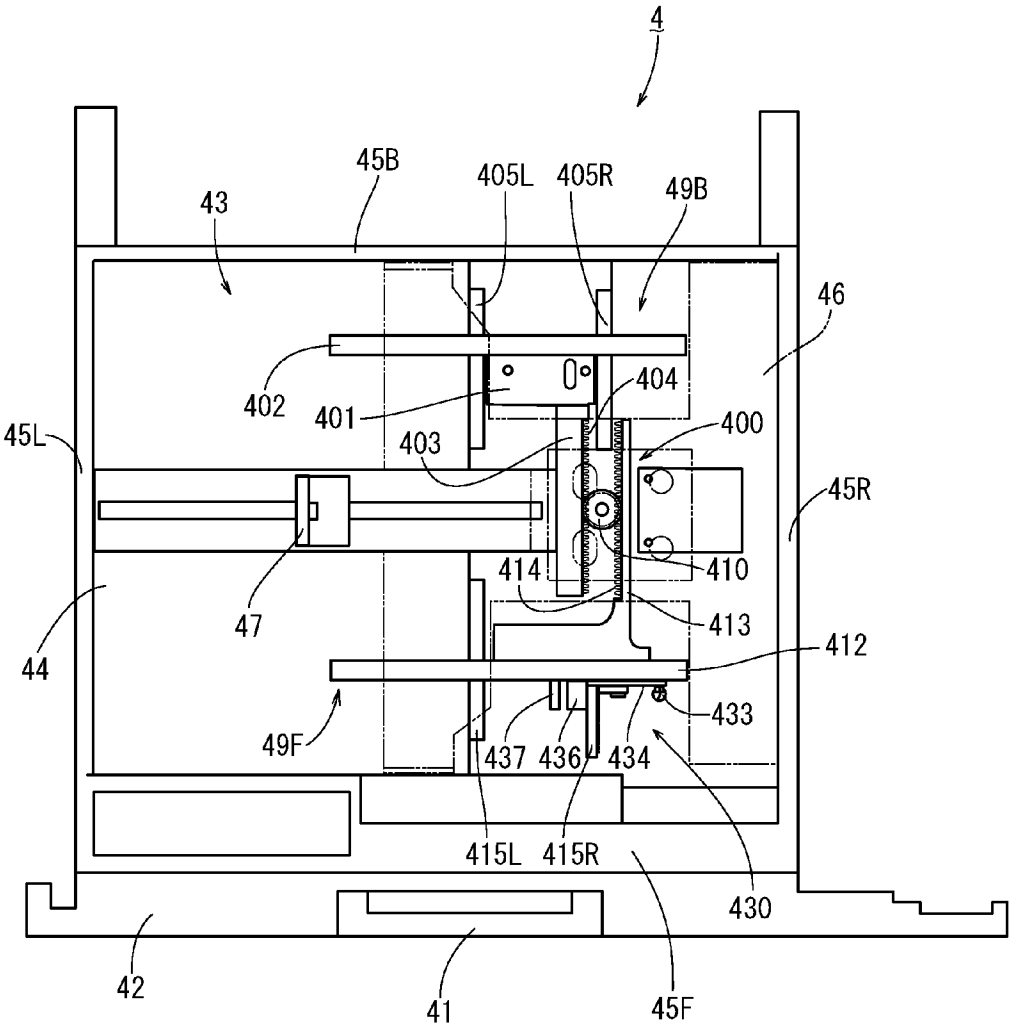
FIG. 5 is a plan view of the paper feeder.
Figure 6:
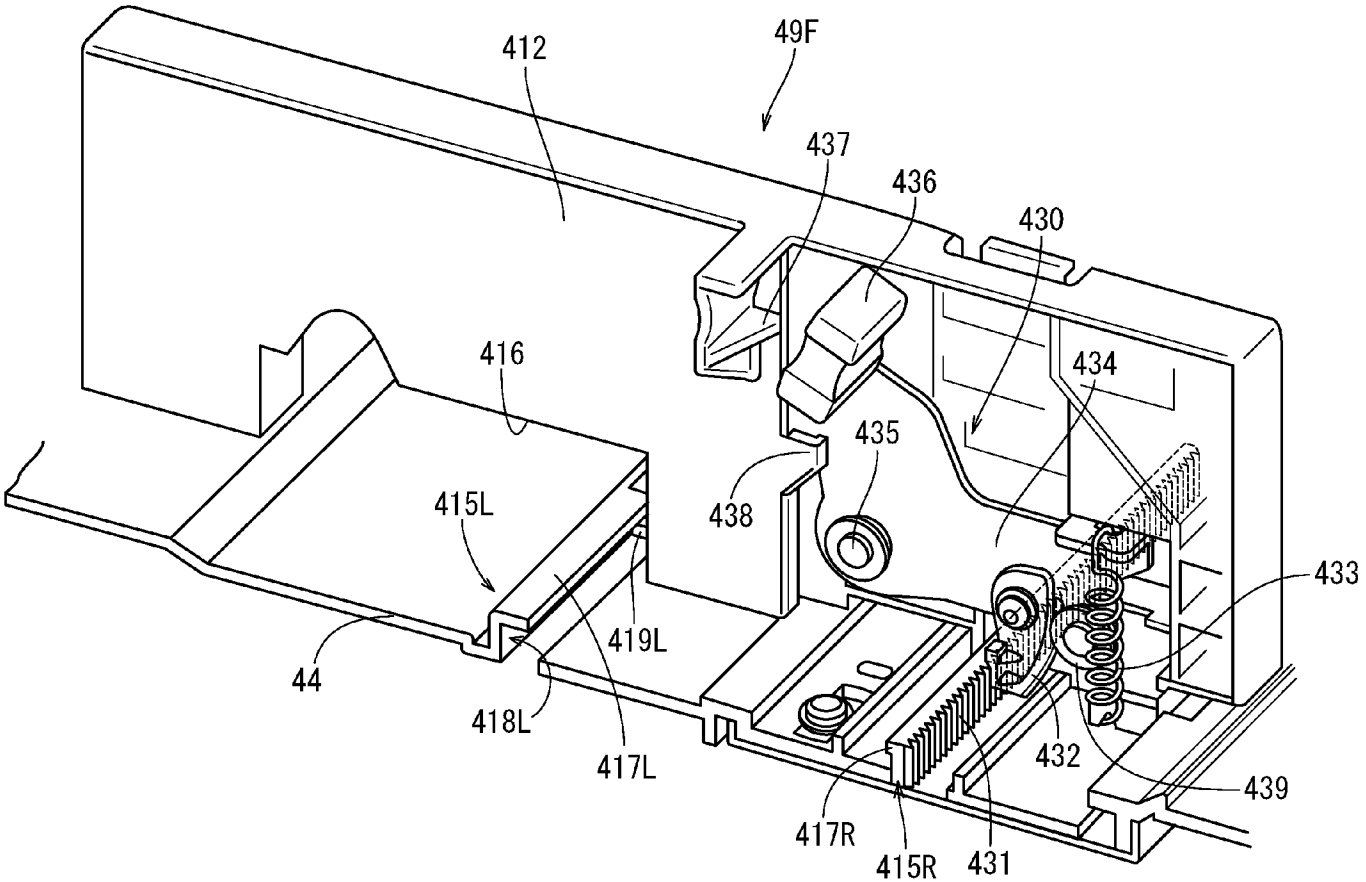
FIG. 6 is an enlarged perspective view of a front paper-width regulating plate as viewed from a diagonally upper right direction.

At the left side plate 45L on the bottom plate 44, a recording medium regulator 47 is disposed. The recording medium regulator 47 protrudes from the bottom plate 44 and is slidable in the right-left direction. The recording medium regulator 47 regulates the left side position of the recording medium P2 so as to keep the right side of the recording medium P2 in contact with the inner wall of the right side plate 45R. A pair of paper-width regulating plates 49F and 49B are disposed upright on the bottom plate 44. The pair of paper-width regulating plates 49F and 49B serve as width regulating members to regulate widthwise positions of the recording medium P2 in the front-rear widthwise direction before the recording medium P2 is fed out (see FIGS. 4 and 5). In this case, the pair of paper-width regulating plates 49F and 49B align the sides of the recording medium P2 before being fed out according to a center standard position. For this purpose, the pair of paper-width regulating plates 49F and 49B cooperate to move toward and away from each other in the front-rear widthwise direction, and hold the recording medium P2 on both sides from the front-rear widthwise direction. This ensures that the recording medium P2 in the recording-media container 43 is set according to the center standard position, regardless of the size of the recording medium P2.

The paper feed mechanism 8 includes a pick-up roller 81 and a pair of separation rollers. The pick-up roller 81 picks up uppermost recording media P2 from among the recording media P2 stored in the recording-media container 43. The pair of separation rollers are made up of a paper feed roller 82 and a separation roller 83 to separate the delivered recording media P2 into an individual recording medium P2. From the recording-media container 43 of each paper feeder 4, the uppermost recording media P2 are conveyed, one at a time, toward a main conveyance passage R0 via paper feed passages R1 by rotational driving of the corresponding pick-up roller 81, paper feed roller 82, and separation roller 83. The main conveyance passage R0 is a main passage for the recording media P2 to be subjected to the process of image forming (printing). The paper feed passages R1 correspond to respective paper feeders 4, and are joined to the main conveyance passage R0.

At one side in the lateral direction of the body 2 (at the right side in this embodiment), a manual paper feed tray 93 is disposed. The manual paper feed tray 93 is used to externally feed recording media P2 of a predetermined size. The manual paper feed tray 93 is an auxiliary tray in addition to the usual paper feeder 4, which is disposed inside the body 2, and is rotatable into open or closed state with respect to the one side in the lateral direction of the body 2. On the manual paper feed tray 93, recording media P2 are disposed, and uppermost recording media P2 are conveyed, one at a time, toward the main conveyance passage R0 via a manual paper feed passage R2 by rotational driving of a pick-up roller and other rollers.

A pair of paper discharge rollers 91 are disposed on the main conveyance passage R0 at a further downstream position than the fixing section, which is made up of the heating roller 59 and the pressure roller 60. The pair of paper discharge rollers 91 discharge the recording medium after subjected to printing. The recording sheet of paper P2 that has undergone printing is discharged onto the paper discharge tray 6 by the rotational driving of the pair of paper discharge rollers 91.

In the body 2, a circulation conveyor 92 is disposed. The circulation conveyor 92 turns over the recording medium P2 that has undergone simplex printing so as to subject the recording medium P2 to duplex printing. The circulation conveyor 92 includes: a pair of reversing rollers to turn over the recording medium P2 that has undergone simplex printing; and a plurality of pairs of duplex conveyance rollers. After simplex printing, the circulation conveyor 92 turns over the recording medium P2 so as to convey the recording medium P2 again to the main conveyance passage R0 via a circulation conveyance passage R3. In this case, the pair of paper discharge rollers 91 are capable of rotating forward and backward, that is, the pair of paper discharge rollers 91 have another function to serve as a pair of reversing rollers. The forward and backward rotation of the pair of paper discharge rollers 91 ensures that the recording medium P2 is discharged to the outside of the image forming apparatus 1 and is switched back (conveyed backward) to the inside of the image forming apparatus 1. The upstream side of the circulation conveyance passage R3 is branched from the main conveyance passage R0 between the fixing section of the image forming device 5 and the pair of paper discharge rollers 91. The downstream side of the circulation conveyance passage R3 is joined to the upstream side of the transfer section of the image forming device 5.

A printing operation by the image forming apparatus 1 will be described briefly. The image forming apparatus 1 starts its printing operation upon receipt of a start signal, an image signal, or another signal. Upon start of the printing operation, a recording medium P2 is picked up from the paper feeder 4 by the paper feed mechanism 8, and conveyed to the image forming device 5 along the main convenience passage R0. The image forming device 5 performs transfer and fixing of an image to the recording medium P2 based on color electrophotography. The method of image transfer to the recording medium P2 employed here is an intermediate transfer method using the intermediate transfer belt 53.

Here, in the image forming sections 51 for YMCK colors in the transfer section of this image forming device 5, a laser beam is irradiated from the exposure section 52 to the surface of the photoreceptor drum 61 charged by the charger 62 so as to form electrostatic latent images corresponding to the images of colors Y, M, C, and K. The toner charged by the developer 63 is transferred to the surface of the photoreceptor drum 61 loaded with the electrostatic latent image, and thus a toner image is formed on the photoreceptor drum 61. Then, when the toner image carried on the surface of the photoreceptor drum 61 is brought into contact with the intermediate transfer belt 53, the toner image is transferred to the intermediate transfer belt 53 by electrostatic force of the primary transfer roller 54. Consequently, the toner images of the respective colors Y, M, C, and K overlapped with each other are formed on the surface of the intermediate transfer belt 53. In the meantime, untransferred toner remaining on the photoreceptor drum 61 after the toner image has been transferred to the intermediate transfer belt 53 is scraped off by the cleaner 64 and removed from the surface of the photoreceptor drum 61.

Upon rotation of the intermediate transfer belt 53 by the driving roller 55 and the driven roller 56, the toner image transferred to the intermediate transfer belt 53 is moved to a transfer position at which to contact with the secondary transfer roller 57. Here, the toner image is transferred to the recording media P2 that has been conveyed to the transfer position on the main conveyance passage R0. In the meantime, untransferred toner remaining on the intermediate transfer belt 53 from which the toner image has been transferred to the recording media P2 is scraped off by the cleaner 58 and removed from the surface of the intermediate transfer belt 53. The recording media P2 loaded with the toner image transferred at the contact position with the secondary transfer roller 57 is conveyed to the fixing section, which is made up of the heating roller 59 and the pressure roller 60.

The recording medium P2 loaded with the unfixed toner image on one surface passes through the fixing position of the fixing section. Here, the recording medium P2 is heated by the heating roller 59 and pressed by the pressure roller 60, and thus the unfixed toner image is fixed to the paper surface. In the case of simplex printing, the recording medium P2 loaded with the fixed toner image (after simplex printing) is discharged onto the paper discharge tray 6 through the pair of paper discharge rollers 91. In the case of duplex printing, the recording medium P2 that has undergone simplex printing is conveyed to the circulation conveyance passage R3 for duplex printing, where the recording medium P2 is turned over and returned to the main conveyance passage R0. At the image forming device 5, a toner image is transferred and fixed to the other surface of the recording medium P2. Then, the recording medium P2 is discharged onto the paper discharge tray 6.

This configuration of the image forming apparatus 1 is common to the image forming apparatuses according to the following embodiments. A difference is the configuration of the paper-width regulating plates 49F and 49B and their peripheries. In view of this, the following description is regarding a detailed configuration of the configuration of the paper-width regulating plates 49F and 49B and their peripheries.

<Detailed Structure of Paper-Width Regulating Plate According to the First Embodiment>

Referring to FIGS. 4 to 8, description will be made with regard to the paper-width regulating plates 49F and 49B according to the first embodiment, which are examples of the width regulating member. The pair of front paper-width regulating plate 49F and rear paper-width regulating plate 49B are upright on the bottom plate 44 in the recording-media container 43, and are coupled to each other through a rack-pinion mechanism 400. The rack-pinion mechanism 400 ensures that the paper-width regulating plates 49F and 49B cooperate with each other to move toward and away from each other (slide to expand or diminish) in the front-rear widthwise direction (direction orthogonal to the paper feed direction of the recording medium P2) of the recording medium P2.

The rear paper-width regulating plate 49B includes a slide plate 401 and a rear contact plate 402. The slide plate 401 is in the form of a plate along the bottom plate 44 of the recording-media container 43. The rear contact plate 402 is upright on the slide plate 401. The contact plate 402 integrally includes a rear rack rod 403, which extends in the front widthwise direction. On the right or left surface (the right surface in the first embodiment) of the rear rack rod 403, rack teeth 404 are aligned in the longitudinal direction of the rear rack rod 403.

At the right on the rear side of the bottom plate 44 in the recording-media container 43, a pair of right rear-hook protrusion 405R and left rear-hook protrusion 405L are formed. The right and left rear-hook protrusions 405R and 405L extend in the front-rear widthwise direction and are laterally symmetrical. Right and left guide grooves (not shown) are defined between the bottom plate 44 in the recording-media container 43 and horizontal claws located at upper portions of the right and left rear-hook protrusions 405R and 405L. The right and left guide grooves hold the slide plate 401 on their right and left sides from the upper-lower direction. The right and left guide grooves are open in opposing, facing directions. The right and left sides of the slide plate 401 are inserted into and engaged with the right and left guide grooves, and the slide plate 401 is slidably moved along the right and left guide grooves. Thus, the rear contact plate 402 (rear paper-width regulating plate 49B) is guided to the front-rear widthwise direction. An escape depression 406 is defined in the rear contact plate 402 at the left of its lower portion. The escape depression 406 has a depressed shape open downward to avoid interference with the push-up plate 46 swinging upward and downward.

The front paper-width regulating plate 49F includes a front contact plate 412. The front contact plate 412 has a thick plate shape with its shorter side extending in the vertical direction. The front contact plate 412 integrally includes a front rack rod 413, which extends in the rear widthwise direction. On the right or left surface (left side surface in the first embodiment) of the rack rod 413, rack teeth 414 are aligned in the longitudinal direction of the front rack rod 413.

At the right on the front side of the bottom plate 44 in the recording-media container 43, a pair of right front-hook protrusion 415R and left front-hook protrusion 415L are formed. The right and left front-hook protrusions 415R and 415L extend in the front-rear widthwise direction and are laterally symmetrical. Right and left guide grooves 418R and 418L are defined between the bottom plate 44 in the recording-media container 43 and horizontal claws 417R and 417L, which are located at upper portions of the right and left front-hook protrusions 415R and 415L. The right and left guide grooves 418R and 418L are open in opposing, facing directions.

Similarly to the rear contact plate 402, an escape depression 416 is defined in the front contact plate 412 at the left of its lower portion. The escape depression 416 has a depressed shape open downward to avoid interference with the push-up plate 46 swinging upward and downward. The escape depression 416 is integral with a left sliding-contact protrusion 419L on the right inner wall of the escape depression 416. The left sliding-contact protrusion 419L protrudes in the left direction. A guide depression 420 is defined in the front contact plate 412 at the right of its lower portion. The guide depression 420 has a depressed shape open downward so that the right front-hook protrusion 415R is inserted (fit) into the guide depression 420. The guide depression 420 is integral with a right sliding-contact protrusion 419R on the left inner wall of the guide depression 420. The right sliding-contact protrusion 419R protrudes in the right direction. The right and left sliding-contact protrusions 419R and 419L protrude in opposing, separating directions, in contrast to the right and left guide grooves 418R and 418L. The right and left sliding-contact protrusions 419R and 419L are respectively inserted into and engaged with the right and left guide grooves 418R and 418L, and the right and left sliding-contact protrusions 419R and 419L are slidably moved along the right and left guide grooves 418R and 418L. Thus, the front contact plate 412 (front paper-width regulating plate 49F) is guided in the front-rear widthwise direction.

On the bottom plate 44 in the recording-media container 43, a pinion gear 410 is horizontally rotatably supported at a center of the bottom plate 44 in the front-rear direction closer to the right side plate 45R. The pinion gear 410 is meshed with rack teeth 414 and 404 respectively of the front rack rod 413 and the rear rack rod 403 as if the pinion gear 410 is held between the rack teeth 414 and 404 from the right-left direction. Thus, the pair of front and rear paper-width regulating plates 49F and 49B ensure that the recording medium P2 in the recording-media container 43 is positioned according to the center standard position, at which the center line in the front-rear direction of the recording-media container 43 (the direction which is orthogonal to the paper feed direction and in which the recording-media container 43 is attached and detached) matches the center line in the front-rear widthwise direction of the recording medium P2. The front rack rod 413 and the rear rack rod 403 respectively of the paper-width regulating plates 49F and 49B and the pinion gear 410 constitute the rack-pinion mechanism 400. In the first embodiment, the front-rear widthwise direction of the recording medium P2 matches (is in parallel to) the direction in which the recording-media container 43 is attached and detached, as described above.

As shown in FIGS. 4 to 8, the paper feeder 4 includes a locking mechanism 430. The locking mechanism 430 steplessly changes the movable range of the paper-width regulating plates 49F and 49B in the front-rear widthwise direction. Since the pair of front and rear paper-width regulating plates 49F and 49B are coupled to each other through the rack-pinion mechanism 400, the locking mechanism 430 is associated with at least one of the paper-width regulating plates 49F and 49B. In the first embodiment, the locking mechanism 430 is associated with the front paper-width regulating plate 49F.

The locking mechanism 430 according to the first embodiment includes the right front-hook protrusion 415R, an engagement tooth body 432, an tensile spring 433, the right sliding-contact protrusion 419R, and the horizontal claw 417R. The right front-hook protrusion 415R is disposed on the bottom plate 44 in the recording-media container 43. The engagement tooth body 432 is disposed on the front contact plate 412 to be engaged with and disengaged from the rack teeth 431 of the right front-hook protrusion 415R. The tensile spring 433 causes a bias in the direction in which the engagement tooth body 432 is engaged with the rack teeth 431 of the right front-hook protrusion 415R. The right sliding-contact protrusion 419R is disposed on the front contact plate 412. The horizontal claw 417R is disposed on the right front-hook protrusion 415R to be engaged with the right sliding-contact protrusion 419R. The right front-hook protrusion 415R constitutes a rack member having a longitudinal dimension in the front-rear widthwise direction. The tensile spring 433 constitutes a bias member. The right sliding-contact protrusion 419R constitutes a first engagement portion. The horizontal claw 417R of the front-hook protrusion 415R on the right constitutes a second engagement portion.

As shown in FIGS. 4 to 7, the right front-hook protrusion 415R is upright on the bottom plate 44 of the recording-media container 43 with the shorter sides of the right front-hook protrusion 415R extending in the vertical direction. The horizontal claw 417R is formed on an upper portion of the right front-hook protrusion 415R on one of the right and left longitudinal wider surfaces (the left longitudinal wider surface in the first embodiment). The horizontal claw 417R extends in the longitudinal direction (the front-rear widthwise direction) of the right front-hook protrusion 415R, and protrudes in left direction. The rack teeth 431 is formed on the other longitudinal wider surface (which is opposite to the horizontal claw 417R) of the right and left longitudinal wider surfaces. The rack teeth 431 are aligned along the longitudinal direction of the right front-hook protrusion 415R. The rack teeth 431 of the right front-hook protrusion 415R have a tooth widthwise direction oriented in the vertical direction.

A lever 434 is disposed on one of the longitudinal wider surfaces (the front longitudinal wider surface in the first embodiment) of the front contact plate 412. The lever 434 cooperates with the front contact plate 412 (front paper-width regulating plate 49F) to hold the locking mechanism 430 so as to bring the locking mechanism 430 into an unlocked state. The lever 434 is in the form of an L-shaped plate, and has a corner portion rotatably supported by a pivotal pin axis 435. The pivotal pin axis 435 is oriented in the lateral direction on the front longitudinal wider surface of the front contact plate 412. The lever 434 has a lateral arm. At the distal end of the lateral arm, the engagement tooth body 432 is attached to be engaged with and disengaged from the rack teeth 431 of the right front-hook protrusion 415R.

The tensile spring 433, which serves as the bias member, is laid across the distal end of the lateral arm of the lever 434 and the right of the lower portion of the front contact plate 412 on the front longitudinal wider surface. The tensile spring 433 continuously causes a bias in the direction in which the lateral arm of the lever 434 swings downward about the pivotal pin axis 435, that is, in the direction in which the engagement tooth body 432 is engaged with the rack teeth 431 of the right front-hook protrusion 415R. When the lever 434 is not handled, the tensile spring 433 effects its elastic recovery force to maintain the mesh between the rack teeth 431 of the right front-hook protrusion 415R and the engagement tooth body 432. This keeps the front and rear paper-width regulating plates 49F and 49B in a locked state where slide movement in the front-rear widthwise direction is impossible. In other words, the engagement of the rack teeth 431 of the right front-hook protrusion 415R with the engagement tooth body 432 restricts the movement of the front and rear paper-width regulating plates 49F and 49B in the front-rear widthwise direction.

The lever 434 has an upper arm. At the distal end of the upper arm, a handle 436 is attached. At the upper portion of the front contact plate 412 on the front longitudinal wider surface, a stopper 437 integral with the front contact plate 412 is disposed to face the handle 436. The stopper 437 sets a limit position under which the lateral arm of the lever 434 is allowed to swing about the pivotal pin axis 435 in the unlocked direction (the upper direction in the first embodiment). When the handle 436 and the stopper 437 are held together to bring the handle 436 closer to and into contact with the stopper 437, the lateral arm of the lever 434 swings upward about the pivotal pin axis 435 against the elasticity of the tensile spring 433. This releases the mesh between the rack teeth 431 of the right front-hook protrusion 415R and the engaging body 432, turning the front and rear paper-width regulating plates 49F and 49B into unlocked state, in which slide movement in the front-rear widthwise direction is possible. When fingers are released from the handle 436 and the stopper 437, the tensile spring 433 effects its elastic recovery force to swing the lateral arm of the lever 434 downward about the pivotal pin axis 435, causing the rack teeth 431 of the right front-hook protrusion 415R to mesh with the engagement tooth body 432. Thus, the front and rear paper-width regulating plates 49F and 49B return to locked state, in which slide movement in the front-rear widthwise direction is impossible.

That is, by swinging the lever 434 about the pivotal pin axis 435 to engage and disengage the engagement tooth body 432 with and from the rack teeth 431 of the right front-hook protrusion 415R, the front and rear paper-width regulating plates 49F and 49B are selectively switched between locked state and unlocked state. In locked state, slide movement is impossible (restricted) in the front-rear widthwise direction, while in unlocked state, slide movement is possible in the front-rear widthwise direction. In this respect, the rack teeth 431 of the right front-hook protrusion 415R are aligned along the longitudinal direction of the right front-hook protrusion 415R. Hence, by moving the front and rear paper-width regulating plates 49F and 49B toward and away from each other in front-rear widthwise direction so as to change the position of mesh between the rack teeth 431 of the right front-hook protrusion 415R and the engagement tooth body 432, the positions of the front and rear paper-width regulating plates 49F and 49B in the front-rear widthwise direction are steplessly changed and maintained. This ensures accurate positioning of recording media P2 of any size, including an undefined size for example, according to the center standard position. In the first embodiment, the pair of front and rear paper-width regulating plates 49F and 49B are coupled with each other through the rack-pinion mechanism 400. Hence, when the front paper-width regulating plate 49F is positioned, the rear paper-width regulating plate 49B is positioned accordingly.

The front contact plate 412 integrally includes a falling prevention piece 438 on the front longitudinal wider surface. The falling prevention piece 438 prevents the upper arm of the lever 434 swinging about the pivotal pin axis 435 from falling in a direction away from the front longitudinal wider surface of the front contact plate 412. Also on the front longitudinal wider surface of the front contact plate 412, a falling prevention washer 439 is attached. The falling prevention washer 439 prevents the engagement tooth body 432 from falling in a direction away from the front longitudinal wider surface of the front contact plate 412.

Figure 7:
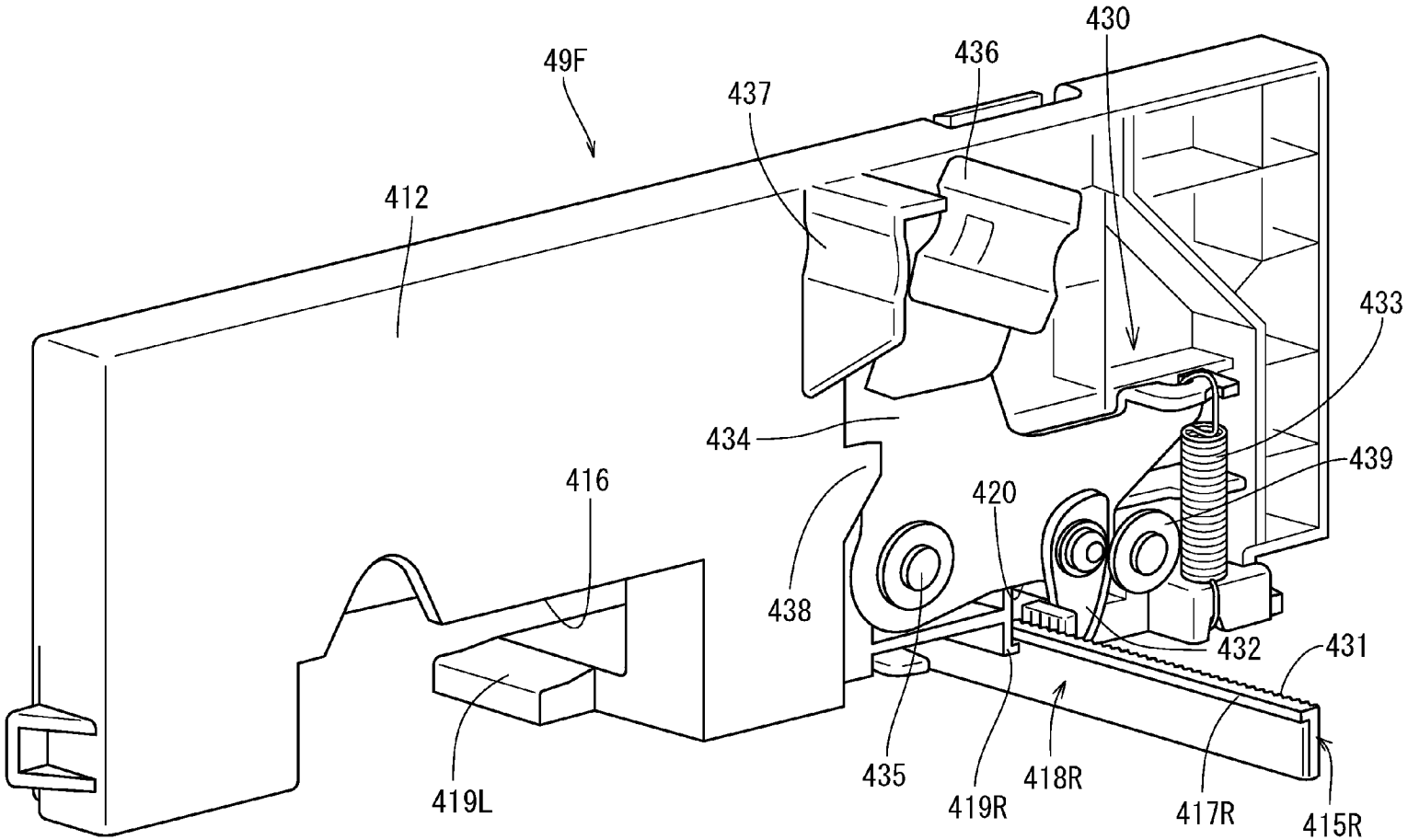
FIG. 7 is an enlarged perspective view of the front paper-width regulating plate as viewed from a diagonally upper left direction.
Figure 8:
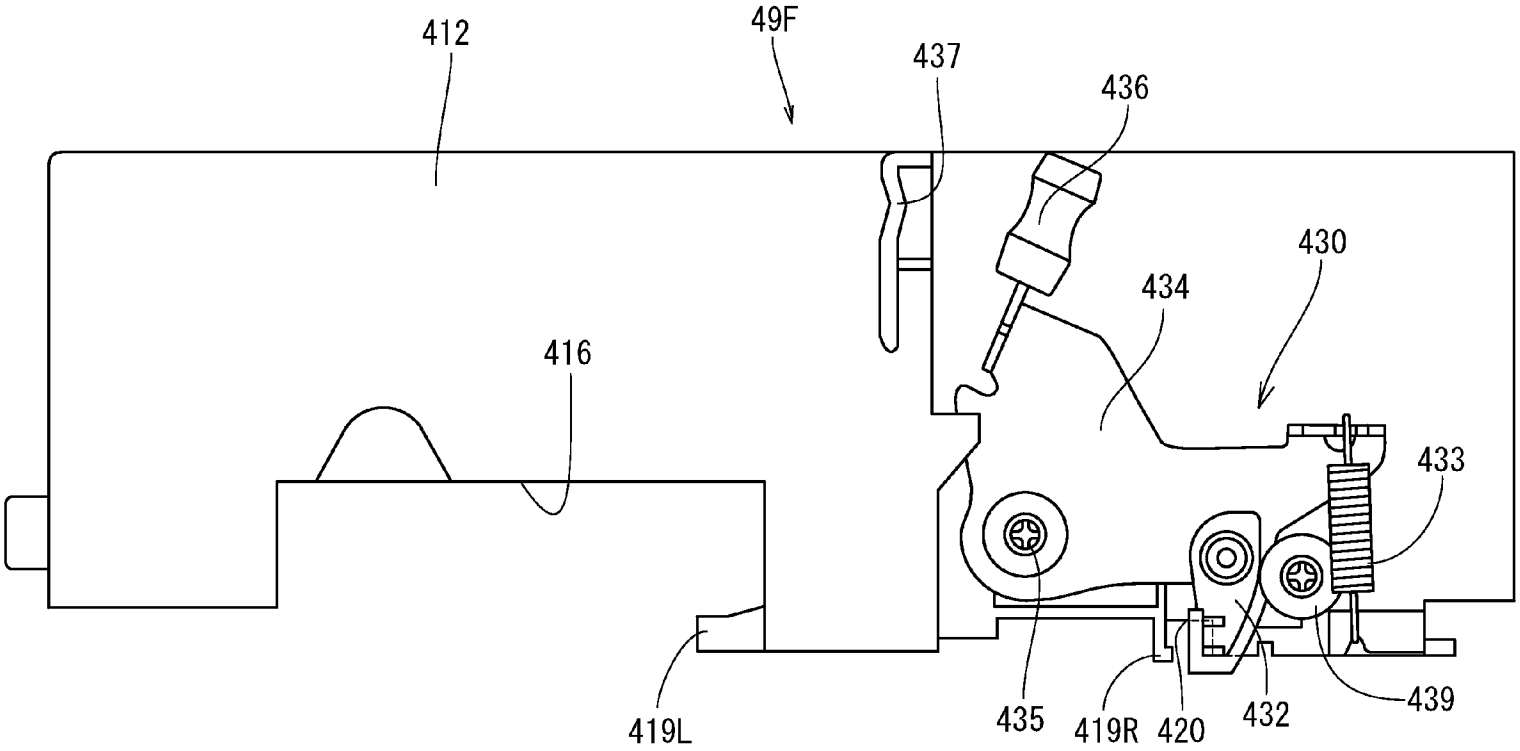
FIG. 8 is an enlarged front view of the front paper-width regulating plate.

As shown in detail in FIGS. 7 and 8, the right sliding-contact protrusion 419R is formed on the left inner wall of the guide depression 420 of the front contact plate 412, and is inserted in a right guide groove 418R. The right guide groove 418R is between the horizontal claw 417R of the right front-hook protrusion 415R and the bottom plate 44 in the recording-media container 43. The right sliding-contact protrusion 419R of the front contact plate 412 is in vertical contact with and engaged with the horizontal claw 417R of the right front-hook protrusion 415R. This keeps the front contact plate 412 (front paper-width regulating plate 49F) from being displaced upward. Thus, when the locking mechanism 430 is in locked state, in which the rack teeth 431 of the right front-hook protrusion 415R mesh with the engagement tooth body 432, the locking mechanism 430 not only restricts the movement of the front and rear paper-width regulating plates 49F and 49B in the front-rear widthwise direction, but also restricts wobbling and upward displacement of the front paper-width regulating plate 49F in the vertical direction orthogonal to the front-rear widthwise direction.

It is preferable that the position at which the right sliding-contact protrusion 419R of the front contact plate 412 is engaged with the horizontal claw 417R of the right front-hook protrusion 415R is closer to the position at which the rack teeth 431 of the right front-hook protrusion 415R mesh with the engagement tooth body 432. The engagement of the right sliding-contact protrusion 419R of the front contact plate 412 with the horizontal claw 417R of the right front-hook protrusion 415R eliminates or minimizes displacement in the vertical direction of the mesh between the rack teeth 431 of the right front-hook protrusion 415R and the engagement tooth body 43, the vertical direction being the tooth widthwise direction of the rack teeth 431 of the right front-hook protrusion 415R. This reduces the possibility of disengagement of the mesh between the rack teeth 431 of the right front-hook protrusion 415R and the engagement tooth body 432.

In particular, in the first embodiment, a gap Ls is defined in the direction (vertical direction) in which the right sliding-contact protrusion 419R of the front contact plate 412 is engaged with the horizontal claw 417R of the right front-hook protrusion 415R. The gap Ls is shorter than the length, Lm, of the mesh between the rack teeth 431 of the right front-hook protrusion 415R and the engagement tooth body 432. This eliminates or minimizes disengagement of the mesh between the rack teeth 431 of the right front-hook protrusion 415R and the engagement tooth body 432, even if the front contact plate 412 (front paper-width regulating plate 49F) is displaced as upward as possible. Thus, the engagement tooth body 432 is less likely detached from the rack teeth 431 of the right front-hook protrusion 415R.

In locked state, in which the rack teeth 431 of the right front-hook protrusion 415R mesh with the engagement tooth body 432, the engagement tooth body 432 and the right sliding-contact protrusion 419R of the front contact plate 412 hold the right front-hook protrusion 415R from the right-left direction. This keeps the front contact plate 412 (front paper-width regulating plate 49F) from being displaced in the right-left direction. This, in turn, enables the locking mechanism 430 in locked state, in which the rack teeth 431 of the right front-hook protrusion 415R mesh with the engagement tooth body 432, to restrict the movement of the front and rear paper-width regulating plates 49F and 49B in the front-rear widthwise direction, to restrict wobbling of the front paper-width regulating plate 49F in the vertical direction orthogonal to the front-rear widthwise direction, and to restrict wobbling of the front paper-width regulating plate 49F in the right-left direction orthogonal to the front-rear widthwise direction.

As has been described hereinbefore, the locking mechanism 430 in locked state needs a simple operation of meshing the rack teeth 431 of the right front-hook protrusion 415R with the engagement tooth body 432 so as to restrict the movement of the front paper-width regulating plate 49F in the following three directions: the front-rear widthwise direction; the vertical direction orthogonal to the front-rear widthwise direction; and the right-left direction orthogonal to the front-rear widthwise direction. That is, the locking mechanism 430 steplessly changes the position of the front paper-width regulating plate 49F in the front-rear widthwise direction and maintains this position while eliminating or minimizing wobbling of the front paper-width regulating plate 49F in the vertical and right-left directions orthogonal to the front-rear widthwise direction. This reliably eliminates or minimizes displacement of the position at which the engagement tooth body 432 meshes with the rack teeth 431 of the right front-hook protrusion 415R, and eliminates or minimizes disengagement of the mesh between the engagement tooth body 432 and the rack teeth 431 of the right front-hook protrusion 415R. Thus, the locking mechanism 430 has an improved function of fixing the position of the front paper-width regulating plate 49F. This, as a result, eliminates or minimizes positional displacement of the front and rear paper-width regulating plates 49F and 49B, even though an impact or a similar occurrence is involved when the recording-media container 43 is attached to and detached from the body 2. It will be readily appreciated that the presence of the rack-pinion mechanism 400 fixes the position of the rear paper-width regulating plate 49B as well as the position of the front paper-width regulating plate 49F.

Additionally, a rack tooth 431 of the right front-hook protrusion 415R individually meshes with the engagement tooth body 432. This minimizes the operation force of the lever 432 necessary for its locking operation and unlocking operation, thereby improving the operability of the lever 432 itself. In addition, by holding the handle 436 of the lever 434 and the stopper 437 of the front contact plate 412 (front paper-width regulating plate 49F) together, unlocked state is implemented in which the mesh between the rack teeth 431 of the right front-hook protrusion 415R and the engagement tooth body 432 is released. By releasing the fingers from the handle 436 and the stopper 437, locked state is implemented in which the rack teeth 431 of the right front-hook protrusion 415R mesh with the engagement tooth body 432. Thus, a one-touch action is realized to implement the lever 434's locking operation and unlocking operation, and the operations of moving the front and rear paper-width regulating plates 49F and 49B in the front-rear widthwise direction. This significantly improves the operability of adjusting the positions of the front and rear paper-width regulating plates 49F and 49B in the front-rear widthwise direction. Thus, the locking mechanism 430 of the front and rear paper-width regulating plates 49F and 49B improves both in operability and position fixing functionality.

The front-rear widthwise direction of the recording medium P2 are parallel to, that is, match the direction in which the recording-media container 43 is attached and detached. Thus, the direction (meshing direction) in which the rack teeth 431 of the right front-hook protrusion 415R are engaged with the engagement tooth body 432 is orthogonal to the direction in which the recording-media container 43 is attached and detached. This reduces the possibility of displacement of the mesh between the rack teeth 431 of the right front-hook protrusion 415R and the engagement tooth body 432 in the front-rear widthwise direction (teeth arrangement direction), even though an impact or a similar occurrence is involved when the recording-media container 43 is attached to and detached from the body 2.

<Detailed Structure of Paper-Width Regulating Plate According to the Second Embodiment>

Figure 9:
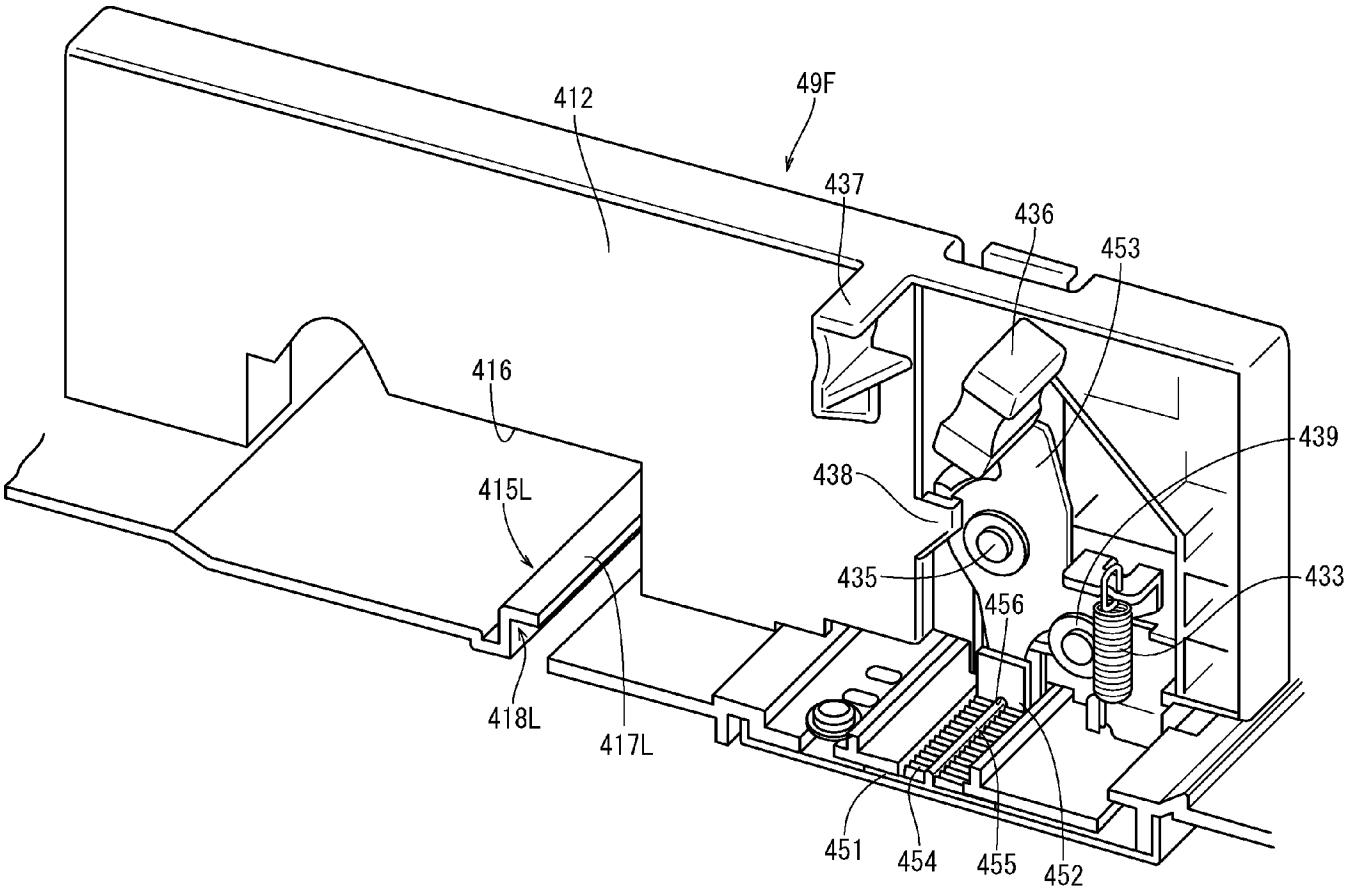
FIG. 9 is an enlarged perspective view of a front paper-width regulating plate according to a second embodiment as viewed from a diagonally upper left direction.

Next, the paper-width regulating plates 49F and 49B according to the second embodiment will be described by referring to FIG. 9. The second embodiment is different from the first embodiment in the following respects. Instead of the right front-hook protrusion 415R, a rack plate 451 is provided as a rack member having a longitudinal dimension in the front-rear widthwise direction. The rack plate 451 is disposed on the bottom plate 44 with the longitudinal wider surfaces of the rack plate 451 in parallel to the bottom plate 44 in the recording-media container 43. The front contact plate 412 has no guide depression 420. Instead, an engagement tooth body 452 having a plate-piece shape is provided at the right of a lower portion on the surface of the front contact plate 412 in a cantilevered manner. A lever 453 has a T-shaped plate.

The rack plate 451 is fixed to a position corresponding to the right front-hook protrusion 415R and extends in the front-rear widthwise direction with the longitudinal wider surfaces of the rack plate 451 in parallel to the bottom plate 44 in the recording-media container 43 (that is, the rack plate 451 is laid down horizontally). On the upper surface of the rack plate 451, rack teeth 454 are aligned in the longitudinal direction of the rack plate 451. The rack teeth 454 of the rack plate 451 have a tooth widthwise direction oriented in the right-left direction. Together with the rack teeth 454, a locking protrusion 455 is disposed on the upper surface of the rack plate 451 to serve as a second engagement portion. The locking protrusion 455 extends in the longitudinal direction of the rack plate 451. The locking protrusion 455 protrudes in the upward direction beyond the rack teeth 454 of the rack plate 451.

The engagement tooth body 452, which is attached to the right of the lower portion on the surface of the front contact plate 412, has a free end that protrudes in front of the front contact plate 412. The engagement tooth body 452 includes an engagement tooth formed at the free end side on the lower surface of the engagement tooth body 452. The engagement tooth is to be engaged with and disengaged from the rack teeth 454 of the rack plate 451. The engagement tooth body 452 also includes an engagement groove 456 in the form of a notch. The engagement groove 456 serves as a first engagement portion to receive the locking protrusion 455 of the rack plate 451. When the engagement tooth body 452 is curved (elastically deformed) to move the free end side downward, the engagement tooth at the free end side on the lower surface of the engagement tooth body 452 meshes with the rack teeth 454 of the rack plate 451, and the engagement groove 456 of the engagement tooth body 452 is fitted with the locking protrusion 455 of the rack plate 451.

The lever 453 has a corner portion rotatably supported by the pivotal pin axis 435. The pivotal pin axis 435 is oriented in the lateral direction on the front longitudinal wider surface of the front contact plate 412. The tensile spring 433 is laid across the distal side of the lateral arm of the lever 453 and the right of the lower portion of the front contact plate 412 on the front longitudinal wider surface. The tensile spring 433 continuously causes a bias in the direction in which the lateral arm of the lever 453 swings downward about the pivotal pin axis 435. The lever 453 has a lower arm that swings about the pivotal pin axis 435 to move closer to and away from the free end side on the upper surface of the engagement tooth body 452. When the lever 434 is not handled, the tensile spring 433 effects its elastic recovery force to bring the lower arm of the lever 453 into contact with the free end side on the upper surface of the engagement tooth body 452. This makes the engagement tooth body 452 curved (elastically deformed) to move the free end side downward, and causes the engagement tooth at the free end side on the lower surface of the engagement tooth body 452 to mesh with the rack teeth 454 of the rack plate 451. At the same time, the engagement groove 456 of the engagement tooth body 452 is fitted with the locking protrusion 455 of the rack plate 451. As a result, the front and rear paper-width regulating plates 49F and 49B are kept in locked state, in which slide movement in the front-rear widthwise direction is impossible. In other words, the engagement of the rack teeth 431 of the right front-hook protrusion 415R with the engagement tooth body 432 restricts the movement of the front and rear paper-width regulating plates 49F and 49B in the front-rear widthwise direction.

The lever 453 has an upper arm. At the distal end of the upper arm, the handle 436 is attached. At the upper portion of the front contact plate 412 on the front longitudinal wider surface, a stopper 437 integral with the front contact plate 412 is disposed to face the handle 436. The stopper 437 sets a limit position under which the lower arm of the lever 453 is allowed to swing about the pivotal pin axis 435 in the unlocked direction (the upper direction in the first embodiment). When the handle 436 and the stopper 437 are held together to bring the handle 436 closer to and into contact with the stopper 437, the lower arm of the lever 453 swings upward about the pivotal pin axis 435 against the elasticity of the tensile spring 433 in a direction away from the engagement tooth body 452. This releases the mesh between the engagement tooth at the free end side on the lower surface of the engagement tooth body 452 and the rack teeth 454 of the rack plate 451, and releases the engagement between the engagement groove 456 of the engagement tooth body 452 and the locking protrusion 455 of the rack plate 451. This, in turn, turns the front and rear paper-width regulating plates 49F and 49B into unlocked state, in which slide movement in the front-rear widthwise direction is possible.

When the fingers are released from the handle 436 and the stopper 437, the tensile spring 433 effects its elastic recovery force to bring the lower arm of the lever 453 into contact with the free end side on the upper surface of the engagement tooth body 452. This makes the engagement tooth body 452 curved (elastically deformed) to move the free end side downward, and causes the engagement tooth at the free end side on the lower surface of the engagement tooth body 452 to mesh with the rack teeth 454 of the rack plate 451. At the same time, the engagement groove 456 of the engagement tooth body 452 is fitted with the locking protrusion 455 of the rack plate 451. As a result, the front and rear paper-width regulating plates 49F and 49B return locked state, in which slide movement in the front-rear widthwise direction is impossible.

The engagement of the locking protrusion 455 of the rack plate 451 with the engagement groove 456 of the engagement tooth body 452 keeps the front contact plate 412 (front paper-width regulating plate 49F) from being displaced in the right-left direction. This, in turn, enables the locking mechanism 430 in locked state, in which the rack teeth 454 of the right plate 451 mesh with the engagement tooth body 452, to restrict the movement of the front and rear paper-width regulating plates 49F and 49B in the front-rear widthwise direction, and to restrict wobbling of the front paper-width regulating plate 49F in the right-left direction orthogonal to the front-rear widthwise direction.

The engagement of the locking protrusion 455 of the rack plate 451 with the engagement groove 456 of the engagement tooth body 452 also eliminates or minimizes displacement of the mesh between the rack teeth 454 of the rack plate 451 and the engagement tooth body 452 in the right-left direction, which is the tooth widthwise direction of the rack teeth 454 of the rack plate 451. This reduces the possibility of disengagement of the mesh between the rack teeth 454 of the rack plate 451 and the engagement tooth body 432. The second embodiment is otherwise similar to the first embodiment.

This configuration ensures that the locking mechanism 430 in locked state needs a simple operation of meshing the rack teeth 454 of the rack plate 451 with the engagement tooth body 452 so as to restrict the movement of the front paper-width regulating plate 49F in the following two directions: the front-rear widthwise direction; and the right-left direction orthogonal to the front-rear widthwise direction. That is, the locking mechanism 430 steplessly changes the position of the front paper-width regulating plate 49F in the front-rear widthwise direction and maintains this position while eliminating or minimizing wobbling of the front paper-width regulating plate 49F in the right-left direction orthogonal to the front-rear widthwise direction. This reliably eliminates or minimizes displacement of the position at which the engagement tooth body 452 meshes with the rack teeth 454 of the rack plate 451, and eliminates or minimizes disengagement of the mesh between the engagement tooth body 452 and the rack teeth 454 of the rack plate 451. Thus, the locking mechanism 430 has an improved function of fixing the position of the front paper-width regulating plate 49F. This, as a result, eliminates or minimizes positional displacement of the front and rear paper-width regulating plates 49F and 49B, even though an impact or a similar occurrence is involved when the recording-media container 43 is attached to and detached from the body 2. It will be readily appreciated that the presence of the rack-pinion mechanism 400 fixes the position of the rear paper-width regulating plate 49B as well as the position of the front paper-width regulating plate 49F.

<Other Notes>

It will be appreciated that the present invention will not be limited to the embodiments described above and can be embodied in various other forms. For example, while an electrophotographic image forming apparatus has been described as an exemplary image forming apparatus, this should not be construed in a limiting sense insofar as the paper feeder according to any of the above-described embodiments is provided. Other possible examples include an image forming apparatus employing an inkjet system. Also, insofar as the paper feeder according to any of the above-described embodiments is provided, the image forming apparatus may be an MFP (Multifunction Peripheral) having a copying function, a scanner function, a printer function, and a facsimile function. Alternatively, the image forming apparatus may be, for example, a printer, a copying machine, or a facsimile. While in the above-described embodiments the center standard position has been exemplified, the present invention is also applicable to the side standard position (one side standard position). In other respects, the configurations of the individual components are not limited to those in the embodiments shown in the drawings, and various changes may be made without departing from the scope of the present invention.

Obviously, numerous modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A paper feeder comprising:

a recording-media container attachable to and detachable from a body of an image forming apparatus, the recording-media container being configured to store a recording medium;

a width regulating member configured to regulate a position in a widthwise direction of the recording medium stored in the recording-media container; and a locking mechanism configured to steplessly change a movable range of the width regulating member in the widthwise direction, wherein the width regulating member comprises a lever configured to cooperate with the width regulating member to hold the locking mechanism so as to bring the locking mechanism into an unlocked state, wherein the locking mechanism in a locked state is configured to restrict movement of the width regulating member in the widthwise direction, and configured to restrict wobbling of the width regulating member in a direction orthogonal to the widthwise direction, wherein the locking mechanism comprises:

a rack member disposed at the recording-media container and comprising a longitudinal dimension in the widthwise direction;

an engagement tooth body to which the lever is coupled, the engagement tooth body being disposed on the width regulating member to be engaged with and disengaged from a rack tooth of the rack member, the engagement tooth body being configured to be engaged with the rack tooth of the rack member so as to restrict the movement of the width regulating member in the widthwise direction;

a first engagement portion disposed on the width regulating member; and a second engagement portion disposed on the rack member, and wherein the first engagement portion is inserted in a guide groove defined between an inner bottom surface of the recording-media container and the second engagement portion, wherein the first engagement portion is adapted to vertically contact with and engage with the second engagement portion while inserted in the guide groove to restrict the wobbling of the width regulating member in the direction orthogonal to the widthwise direction.

2. The paper feeder according to claim 1, wherein the locking mechanism further comprises a bias member configured to bias the engagement tooth body in a direction in which the engagement tooth body is engaged with the rack tooth of the rack member.

3. The paper feeder according to claim 2, wherein the rack member is upright on the inner bottom surface of the recording-media container with a shorter side of the rack member being along a vertical direction, and wherein the direction orthogonal to the widthwise direction is along a tooth widthwise direction of the rack tooth of the rack member.

4. The paper feeder according to claim 3, wherein a gap is defined between the first engagement portion and the second engagement portion in an engagement direction in which the first engagement portion and the second engagement portion are engaged with each other, the gap being smaller than a length over which the rack tooth of the rack member meshes with the engagement tooth body.

5. The paper feeder according to claim 4, wherein a direction in which the recording-media container is attached and detached is parallel to the widthwise direction.

6. The paper feeder according to claim 3, wherein while the rack tooth of the rack member is engaged with the engagement tooth body, the rack member is held between the engagement tooth body and the first engagement portion.

7. The paper feeder according to claim 6, wherein a direction in which the recording-media container is attached and detached is parallel to the widthwise direction.

8. The paper feeder according to claim 3, wherein a direction in which the recording-media container is attached and detached is parallel to the widthwise direction.

9. An image forming apparatus comprising the paper feeder according to claim 3.

10. The paper feeder according to claim 2, wherein while the rack tooth of the rack member is engaged with the engagement tooth body, the rack member is held between the engagement tooth body and the first engagement portion.

11. The paper feeder according to claim 10, wherein a direction in which the recording-media container is attached and detached is parallel to the widthwise direction.

12. The paper feeder according to claim 2, wherein a direction in which the recording-media container is attached and detached is parallel to the widthwise direction.

13. An image forming apparatus comprising the paper feeder according to claim 2.

14. The paper feeder according to claim 1, wherein a direction in which the recording-media container is attached and detached is parallel to the widthwise direction.

15. An image forming apparatus comprising the paper feeder according to claim 1.

* * * * *